US006460784B1

(12) United States Patent
Popov

(10) Patent No.: US 6,460,784 B1
(45) Date of Patent: Oct. 8, 2002

(54) LIQUID-GAS JET APPARATUS

(75) Inventor: Serguei A. Popov, 4615 Post Oak Pl., Suite 140, Houston, TX (US) 77027

(73) Assignees: Evgueni D. Petroukhine, Limassol (CY); Serguei A. Popov, Budapest (HU)

( * ) Notice: Subject to any disclaimer, the term of this patent is extended or adjusted under 35 U.S.C. 154(b) by 0 days.

(21) Appl. No.: 09/445,541

(22) PCT Filed: Feb. 13, 1998

(86) PCT No.: PCT/RU98/00035

§ 371 (c)(1),
(2), (4) Date: Dec. 8, 1999

(87) PCT Pub. No.: WO99/41506

PCT Pub. Date: Aug. 19, 1999

(51) Int. Cl.[7] ..... B05B 7/06

(52) U.S. Cl. ..... 239/423; 239/419.5; 239/418; 239/424; 239/425.5; 417/195; 417/54

(58) Field of Search ..... 239/398, 418, 239/419.5, 423, 424, 425.5; 417/51, 54, 179, 195, 196, 198

(56) References Cited

U.S. PATENT DOCUMENTS

| | | | | | |
|---|---|---|---|---|---|
| 170,407 | A | * | 11/1875 | Silber | 239/425.5 |
| 958,789 | A | * | 5/1910 | Worthen | 239/419.5 |
| 2,582,069 | A | | 1/1952 | Rose | |
| 2,632,597 | A | | 3/1953 | Boeckler | |
| 4,263,346 | A | * | 4/1981 | Sandell | 239/424 |
| 4,592,509 | A | * | 6/1986 | Moss | 239/424 |
| 6,250,890 | B1 | * | 6/2001 | Popov | 417/195 |

FOREIGN PATENT DOCUMENTS

| | | |
|---|---|---|
| DE | 51229 | 4/1890 |
| RU | 2016268 | 7/1994 |
| SU | 767405 | 9/1980 |
| SU | 1755714 | 8/1992 |

* cited by examiner

*Primary Examiner*—Robin O. Evans
(74) *Attorney, Agent, or Firm*—Mark A. Oathout

(57) ABSTRACT

In the field of jet technology a nozzle of a liquid-gas jet apparatus for feed of an active liquid medium has a central channel and a peripheral annular channel and the total surface area of the outlet cross-section of the nozzle channels is determined from the following formula: $S=S_{\mu}(1+\sqrt{(S_{kc}/S_{\mu})^3})$, where S—is the total surface area of the outlet cross-section of the nozzle; $S_{\mu}$—is the surface area of the outlet cross-section of the central channel of the nozzle; and $S_{kc}$—is the surface area of the minimal cross-section of the mixing chamber. A liquid-gas jet apparatus with the above-mentioned features has a higher efficiency and an improved reliability.

3 Claims, 1 Drawing Sheet

LIQUID-GAS JET APPARATUS

BACKGROUND OF THE INVENTION

The present invention pertains to the field of jet technology, primarily to vacuum jet apparatuses being used in various processes for evacuation of gas-vapor mediums. A vacuum jet apparatus, with a nozzle for discharge of an active steam medium, a mixing chamber and a diffuser, is known (see German patent No. 51229, H cl. 59c, 13, 1890).

However, this jet apparatus has a low efficiency factor. As a consequence, a large input of energy is necessary for creating reduced pressure with this device.

The closest analogue selected by the authors as the starting point for this invention, is a liquid-gas jet apparatus, containing a nozzle with a branch pipe for delivery of an active liquid medium and a mixing chamber (see, for example, U.S. Pat. No. 2,632,597, H cl., 417–196, 1953).

This jet apparatus is rated for a relatively low mass flow of an active liquid and, due to the scaling factor effect, the apparatus is not effective when a high mass flow of the active liquid is necessary.

SUMMARY OF THE INVENTION

The technical problem to be solved by this invention is an increase in reliability of a liquid-gas jet apparatus by providing a more steady stream of an active liquid medium and reducing energy losses during interaction of the active (ejecting) medium with a passive (ejected) medium.

The above mentioned problem is solved as follows: a nozzle of a liquid-gas jet apparatus, where the liquid-gas jet apparatus has a nozzle for feed of an active liquid medium and a mixing chamber, has a central channel and a peripheral annular channel. The total surface area of the outlet cross-section of the nozzle is determined from the following formula:

$$S=S_{\mu}(1+\sqrt{(S_{kc}/S_{\mu})^3}),$$

where

S—is the total surface area of the outlet cross-section of the nozzle (i.e. the total surface area of the outlet cross-sections of the central and peripheral channels);

$S_{\mu}$—is the surface area of the outlet cross-section of the central channel of the nozzle;

$S_{kc}$—is the surface area of the minimal cross-section of the mixing chamber.

The outlet cross-section of the central channel of the nozzle can lie in the plane of the outlet cross-section of the annular peripheral channel, or the outlet cross-section of the peripheral channel can be shifted in the counter-flow direction relative to the outlet cross-section of the central channel.

It was discovered that the nozzle for feed of an active liquid medium composed of a central channel and a peripheral annular channel ensures more effective use of the energy of the active liquid medium due to a reduction of energy losses during interaction between the active (ejecting) and passive mediums. Primary contact of the active and passive streams is accompanied by energy interchange between the streams, which is why discharge of the ejecting medium through the peripheral annular channel reduces kinetic energy losses during interaction of the streams.

In addition, availability of two jets of the active medium causes significant expansion of a peripheral unstable (turbulent) area of the active medium stream. This promotes creation of a zone of gradual increase of kinetic energy of the passive gaseous medium from the peripheral to the central area of the stream. This is especially important in the case of evacuation of a gas-vapor medium. When relatively large (in comparison with gas molecules) drops of condensate of the vapor phase of the evacuated gas-vapor medium get into the unstable (turbulent) zone of the active medium stream, loss of kinetic energy is minimal because in this zone the drops are accelerated without disintegration. Experiments showed that the optimal ratio between the surface areas of the central and peripheral channels of the nozzle and the surface area of the minimal cross-section of the mixing chamber is of great importance for effective implementation of the above described mode of mixing of the streams of active liquid and passive gas-vapor mediums.

It was determined that for the liquid-gas jet apparatuses with various rated performances, the most reasonable $S_{kc}/S_{\mu}$ ratio ranges from 10 to 78 and the most reasonable $S_{kc}/S$ ratio ranges from 2.4 to 7.93.

In particular circumstances the relative spatial position of the outlet cross-sections of the central and peripheral channels of the nozzle is of great importance for the effective functioning of the liquid-gas jet apparatus. The most common case is when the outlet cross-sections of the central and peripheral channels are located in the same cross-sectional plane. However, in some cases there is a high content of easy-condensable vapors in the evacuated gaseous medium and consequently there are many dispersed liquid drops in it. In such cases it is advisable to shift the outlet cross-section of the peripheral channel in the counter-flow direction in order to prolong the time of contact of the active and passive mediums and to accelerate the passive medium gradually with minimal losses of kinetic energy during its interaction with the active stream.

So, the introduced design of the liquid-gas jet apparatus provides a solution to the stated technical problem, i.e. the jet apparatuses of the introduced design exhibit an improved operational reliability and a higher efficiency during evacuation of various gas-vapor mediums.

DETAILED DESCRIPTION

Figure 1:
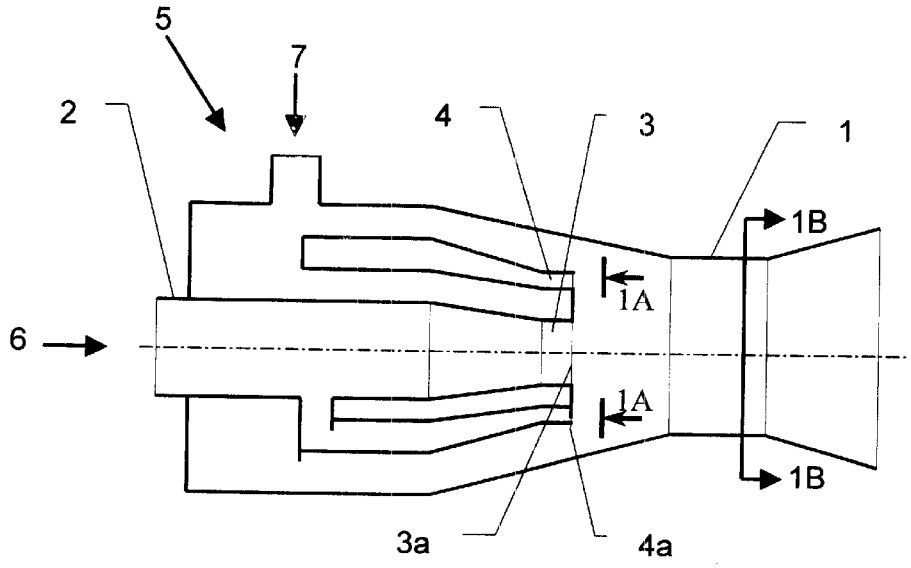
FIG. 1 represents a schematic diagram of one embodiment of the described liquid-gas jet apparatus.
Figure 1A:
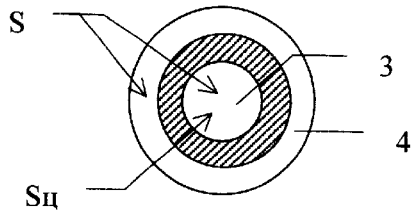
FIG. 1A is a cross-sectional view taken along line 1A—1A of FIG. 1.
Figure 1B:
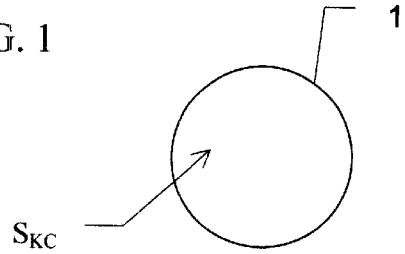
FIG. 1B is a cross-sectional view taken along line 1B—1B of FIG. 1.

The liquid-gas jet apparatus 5 has a mixing chamber 1 and a nozzle 2 for feed of an active liquid medium through inlet 6. The nozzle 2 is composed of a central channel 3 and a peripheral annular channel 4. The total surface area S of the outlet cross-section of the nozzle 2, surface area of the outlet cross-section of the central channel 3 and surface area of the minimal cross-section of the mixing chamber 1 are in the following interrelationship:

$$S=S_{\mu}(1+\sqrt{(S_{kc}/S_{\mu})^3}),$$

where $S_{\mu}$—is the surface area of the outlet cross-section of the central channel 3 of the nozzle 2;

$S_{kc}$—is the surface area of the minimal cross-section of the mixing chamber 1.

Figure 2:
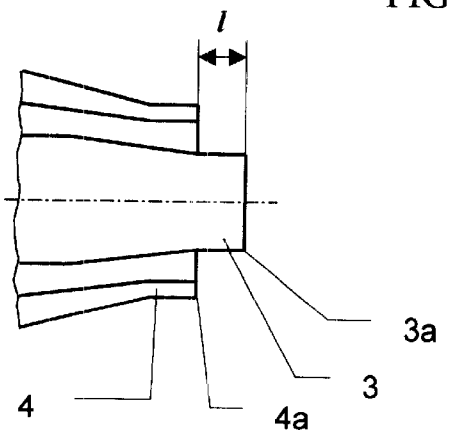
FIG. 2 shows a schematic diagram of another embodiment of the liquid-gas jet apparatus, wherein the outlet cross-section of the peripheral annular channel of the active nozzle is shifted in the counter-flow direction relative to the outlet cross-section of the central channel.

The outlet cross-section 3*a* of the central channel 3 can either lie in a plane (depicted by 3*a* and 4*a* in FIG. 1) in common with the outlet cross-section 4*a* of the peripheral annular channel 4 as shown in FIG. 1; or as shown in FIG. 2 the outlet cross-section 4*a* of the peripheral channel 4 can lie in a plane (depicted by 4*a* in FIG. 2) which is shifted in relation to the outlet cross-section 3*a* of the central channel 3 in the counter-flow direction by the distance 1, which can be determined as follows: $l=(0.56\div 11.28)\sqrt{S_{\mu}}$.

The liquid-gas jet apparatus 5 operates as follows:

An active liquid medium flowing from inlet 6 to the central 3 and peripheral 4 channels of the nozzle 2, entrains a gaseous or a gas-vapor passive medium from a passive medium inlet 7 into the mixing chamber 1. A liquid-gas flow is formed in the mixing chamber 1 as the result of mixing of the active and passive mediums. Then the liquid-gas mixture passes from the mixing chamber 1 to its destination, for example into a separator (not shown), where the liquid evacuating medium is separated from the compressed evacuated gas.

Industrial Applicability:

The proposed liquid-gas jet apparatus may be applied in various industries, where vacuum processes are used, especially in the petrochemical industry for vacuum refinement of an oil stock in vacuum rectification columns.

What is claimed is:

1. A liquid-gas jet apparatus, comprising:

a nozzle having an active liquid medium inlet;

a mixing chamber connected to a passive medium inlet;

wherein the nozzle includes a central channel and a peripheral annular channel;

wherein a total surface area of an outlet cross-section of the nozzle is determined from the formula:

$$S=S_{\mu}(1+\sqrt{(S_{kc}/S_{\mu})^3}),$$

where

S is the total surface area of the outlet cross-section of the nozzle;

$S_{\mu}$ is a surface area of an outlet cross-section of the central channel of the nozzle; and $S_{kc}$ is a surface area of a minimal cross-section of the mixing chamber.

2. The apparatus according to claim 1, wherein the outlet cross-section of the central channel lies in a plane in common with an outlet cross-section of the peripheral channel.

3. The apparatus according to claim 1, wherein an outlet cross-section of the peripheral channel lies in a plane which is shifted in the counter-flow direction in relation to the outlet cross-section of the central channel.

* * * * *